US010399714B2

(12) United States Patent
Rizzieri

(10) Patent No.: US 10,399,714 B2
(45) Date of Patent: Sep. 3, 2019

(54) PROCESS FOR PACKAGING STICKY SUBSTANCES IN THE FLUID PHASE WITH A THIN FILM

(71) Applicant: SAV HOLDING S.p.A., Milan (IT)

(72) Inventor: Giorgio Rizzieri, Settimo Milanese (IT)

(73) Assignee: SAV HOLDING S.p.A., Milan (IT)

( * ) Notice: Subject to any disclaimer, the term of this patent is extended or adjusted under 35 U.S.C. 154(b) by 0 days.

(21) Appl. No.: 16/060,302

(22) PCT Filed: Dec. 6, 2016

(86) PCT No.: PCT/IB2016/057372

§ 371 (c)(1),
(2) Date: Jun. 7, 2018

(87) PCT Pub. No.: WO2017/098400

PCT Pub. Date: Jun. 15, 2017

(65) Prior Publication Data

US 2018/0354663 A1 Dec. 13, 2018

(30) Foreign Application Priority Data

Dec. 11, 2015 (IT) ..... 102015000082429

(51) Int. Cl.
*B65B 3/02* (2006.01)
*B65B 3/12* (2006.01)
(Continued)

(52) U.S. Cl.
CPC ..... *B65B 3/022* (2013.01); *B65B 3/10* (2013.01); *B65B 3/12* (2013.01); *B65B 9/04* (2013.01);
(Continued)

(58) Field of Classification Search
CPC .. B65B 3/022; B65B 3/10; B65B 3/12; B65B 9/04; B65B 9/042; B65B 47/02;
(Continued)

(56) References Cited

U.S. PATENT DOCUMENTS 2,982,067 A * 5/1961 Dakin ..... B29C 51/225 53/329.4
3,000,157 A * 9/1961 Ollier ..... B29C 51/26 493/108
(Continued)

FOREIGN PATENT DOCUMENTS

EP 0 718 199 B1 1/2000
WO 9413451 A1 6/1994
WO 2005021384 A1 3/2005

OTHER PUBLICATIONS

International Search Report for International Patent Application No. 2005021384 dated Apr. 24, 2017.
(Continued)

*Primary Examiner* — Nathaniel C Chukwurah
*Assistant Examiner* — Lucas E. A. Palmer
(74) *Attorney, Agent, or Firm* — Pearne & Gordon LLP

(57) ABSTRACT

Process for packaging sticky substances in the molten state, in which the sticky substance is cast in a tray-mold lined be-forehand with a film of non-sticky plastic material and compatible in the fluid state with the sticky substance, including, among other, the phase of lining the internal walls of the tray-molds with a first thin and easily formable film of the non-sticky plastic material, causing it to perfectly adhere to the walls of the mold by connecting the lower external part of the molds connection to a vacuum source, in which the degree of vacuum during the opening transient of the connection is modulated.

15 Claims, 1 Drawing Sheet

(51) Int. Cl.

| | |
|---|---|
| ***B65B 47/10*** | (2006.01) |
| ***B65B 51/10*** | (2006.01) |
| ***B65B 57/00*** | (2006.01) |
| ***B65B 63/08*** | (2006.01) |
| ***B65B 9/04*** | (2006.01) |
| ***B65B 47/02*** | (2006.01) |
| ***B65B 3/10*** | (2006.01) |

(52) U.S. Cl.
CPC ..... *B65B 9/042* (2013.01); *B65B 47/02* (2013.01); *B65B 47/10* (2013.01); *B65B 51/10* (2013.01); *B65B 57/00* (2013.01); *B65B 63/08* (2013.01); *B65B 2220/24* (2013.01)

(58) Field of Classification Search
CPC ..... B65B 47/10; B65B 51/10; B65B 57/00; B65B 63/08; B65B 2220/24; B65B 11/52; B65B 31/00
USPC ..... 53/440, 432, 433, 453, 122, 127, 510, 53/511, 559; 264/46.8; 156/287
See application file for complete search history.

(56) References Cited

U.S. PATENT DOCUMENTS 3,815,322 A * 6/1974 Wyslotsky ..... B65B 9/04 425/143
4,200,481 A * 4/1980 Faller ..... B29C 51/165 156/285
4,748,796 A * 6/1988 Viel ..... B65B 1/04 156/245
5,160,686 A * 11/1992 Thaler ..... B05B 7/0861 264/255
5,257,491 A * 11/1993 Rouyer ..... B29B 13/022 206/447
5,333,439 A * 8/1994 Bozich ..... B65B 33/00 206/447
5,401,455 A * 3/1995 Hatfield ..... B29B 13/022 264/255
5,715,654 A * 2/1998 Taylor ..... B29B 13/022 264/255
5,725,820 A * 3/1998 Reynolds ..... B29C 31/044 264/135
5,806,285 A * 9/1998 Rizzieri ..... B29C 66/87443 53/122
5,987,852 A * 11/1999 Bozich ..... B65B 63/08 53/440
6,257,866 B1 * 7/2001 Fritz ..... B29C 51/06 425/387.1
6,517,649 B1 * 2/2003 Rugg ..... B29C 51/46 156/286
6,533,564 B1 * 3/2003 Haas ..... B29C 47/0023 425/112
2004/0119198 A1 * 6/2004 Alper ..... B65B 63/08 264/237
2005/0252600 A1 * 11/2005 van Driesten ..... B32B 7/14 156/152
2006/0093764 A1 * 5/2006 Mehta ..... B65B 63/08 428/35.2
2007/0057413 A1 * 3/2007 Haney ..... B29C 70/443 264/510
2009/0071100 A1 3/2009 Ehrmann et al.
2009/0199877 A1 * 8/2009 Koch ..... C11D 17/042 134/42
2010/0095640 A1 * 4/2010 Grimm ..... B29C 51/10 53/453
2010/0107569 A1 * 5/2010 Havemann ..... B29C 57/10 53/479
2010/0251671 A1 * 10/2010 Thompson ..... B65B 63/08 53/440
2013/0309427 A1 * 11/2013 Chen ..... B65B 1/04 428/35.5
2014/0033650 A1 * 2/2014 Splinter ..... B65B 3/04 53/410
2014/0054831 A1 2/2014 Emerson et al.
2014/0120649 A1 * 5/2014 Nakahama ..... H01L 31/048 438/66

OTHER PUBLICATIONS

Written Opinion for International Patent Application No. 2005021384 dated Apr. 24, 2017.

* cited by examiner

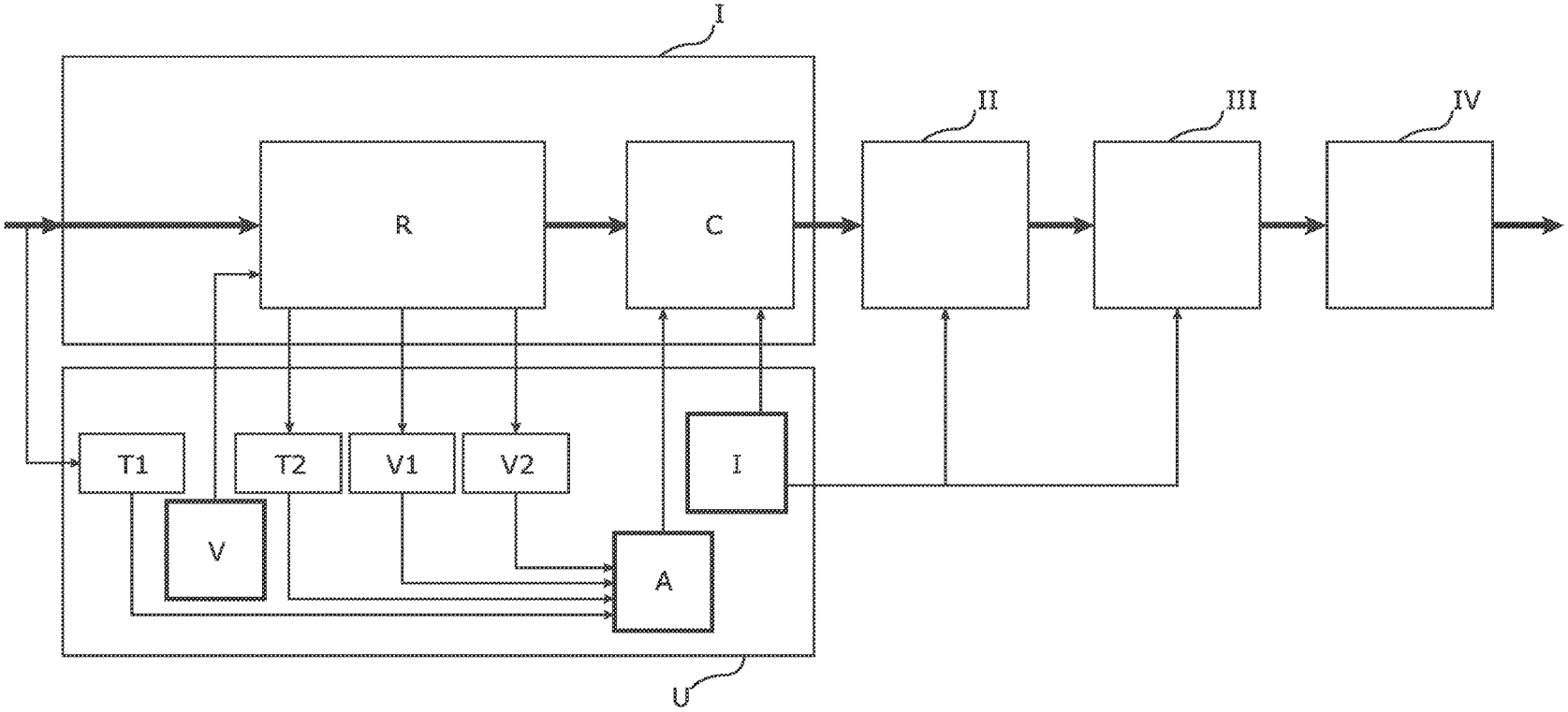
I
R
C
II
III
IV
T1
V
T2
V1
V2
A
I
U

PROCESS FOR PACKAGING STICKY SUBSTANCES IN THE FLUID PHASE WITH A THIN FILM

This application is a National Stage application of PCT international application PCT/IB2016/057372, filed on Dec. 6, 2016 which claims the priority of Italian Patent Application No. 102015000082429, filed on Dec. 11, 2015, both of which are incorporated herein by reference in their entirety.

FIELD OF THE INVENTION

The present invention relates to a packaging process, in a thin film of non-sticky plastic material, of substances in the molten state, which, once cooled to room temperature, are solid and sticky. The lining with a thin film of the sticky substance has the aim to make it easily handled because the film allows to grab a piece of the sticky substance and to release it without any problems of detachment from the hands of the operator or from any other tool used for the handling thereof. In particular, the thin film used for the packaging preferably has a softening temperature lower than the melting temperature of the sticky substance.

The process of the present invention is addressed in particular to the packaging of adhesives and sealants which are sticky and solid at room temperature, the so-called hot-melts, which are applied onto the final supports used in the molten state, and then at temperatures above the room temperature. However, the process of the present invention is not limited to such products, but is equally applicable with the same advantages for the packaging of other substances that are solid and sticky at room temperature, such as, for example, alimentary pastes or food products, detergents and cosmetics, and the like. Although, therefore, for the sake of clarity in the following particular reference will be made to adhesive products only, it is understood that this definition should be interpreted by way of example and not of limitation of the scope of the process according to the present invention.

STATE OF THE PRIOR ART

Currently, hot-melt packaging is performed according to two main categories of process: a in-water process and a dry process.

In the first category, three different types of process are currently known and applied industrially; instead, in the second category a single type of process is known and industrially applied. These four processes of the prior art will be briefly described below.

In a first type of the in-water method, the molten hot-melt adhesive is extruded to obtain small pieces, which are immediately dipped in a bath of cooling water, mixed with a release agent, and solidify into a rounded shape on cooling. The solidified hot-melt pieces, lined with the film of release agent coated thereon, are then dried and, if necessary, inserted in groups within heat-sealed packaging plastic bags.

In a second type of the in-water method, the molten hot-melt adhesive is extruded into a bath of cooling water, while a cylindrical film of non-sticky plastic material is coextruded simultaneously around the extruded hot-melt adhesive. A continuous cylinder of hot-melt adhesive lined by a film is so obtained which, after the co-extrusion, is cut into pieces. The pieces thus cut off, which show the not protected hot-melt adhesive at the two opposite ends, are again dried and possibly inserted in groups within heat-sealed plastic packaging bags.

In a third type of process, the hot-melt adhesive in the molten state is cast inside a lining tubular film, and the assembly thus formed is dipped in a cooling liquid to prevent the lining tubular film from dissolving by the heat of the molten hot-melt adhesive. Once cooled, the tubular film filled with the molten material is pinched at regular distances such as to form a sausage-like structure to determine individual pieces of hot-melts, and then cooled, dried and finally separated into said individual pieces, by cutting and welding the film in the pinched regions for the subsequent packaging of the cakes thus obtained within boxes. (WO9413451-National Starch)

In the fourth type of process, the hot-melt adhesive in the molten state is cast into perforated metal moulds—mounted on a suitable continuous tray conveyor system—covered beforehand with a first lining film maintained closely adjacent to the mould thanks to a depression formed in the external bottom of the mould. Thanks to the perfect adhesion of the film to the metal mould and to the fact that the casting is performed in a controlled and regular way, and then with a non-turbulent flow, the heat of the molten sticky material is dissipated by the metal mould without the lining film—although partially molten—can be mixed with the molten adhesive material cast into the mould. The accumulated heat in the moulds is dissipated by simple ventilation. After a period of time sufficient to cause the cooling of the upper layer of the molten material, cast in the mould, to below the softening temperature of the lining film, said upper layer is covered with a second film, and the two films are mutually heat-sealed at the mould edge where they are in contact. At the end of the conveying system, the hot-melt cakes thus obtained are released from the mould and cooled to room temperature for subsequent packaging within boxes. (EP-718199).

The last process described above is the only known industrial dry packaging process, not taking into consideration a very expensive packaging process with high manual labour input, where the sticky product is cast into non-adherent moulds allowed to cool, and then each piece of sticky substance is manually extracted from the moulds and wrapped in the film, with the difficulty deriving from the direct manipulation of this type of substances.

The packaged molten material cakes obtained by means of the above-mentioned four types of process, have characteristics that are partially different. In particular, the cakes obtained by the first and the second in-water process have the disadvantage due to the potential presence of the second packaging bag, which is necessary—in particular for the products that have a high degree of stickiness and a low viscosity at room temperature—because the individual pieces of hot-melt adhesive are not, or are only partially, covered by a non-sticky film material, and then they easily got stuck to each other. The presence of the external bag, however, creates serious problems in the melting devices, since the material of the bag is not intimately joined to the adhesive and therefore tends to separate, floating or clogging the outlet filters of said devices.

The third process, which also uses cooling water, has undoubted advantages compared to the previous two processes, but it is not free from drawbacks. In fact, the cakes obtained with said process have a non-optimal sealing at the pinched regions, because some sticky material inevitably remains interposed between the two flaps of the film after the pinching operation, and which hinders a good heat-welding between the opposite flaps of the packaging non-sticky plastic material; therefore, these cakes can suffer from potential leakage problems of sticky material outside of the cake during transport and storage, in particular in relation to low-viscosity products and under temperature and stacking mechanical stress conditions that facilitate the cold flow phenomena. Furthermore, the cakes produced using this packaging process have a cylindrical shape with a circular cross-section that does not allow an optimal filling of the packaging boxes.

The adhesive cakes packaged by using the fourth dry process have the best quality among all those reported here, thanks to the fact that the two lining films, which wrap the cake, in addition to being intimately bound to the sticky substance, can be entirely sealed to one another, without showing any welding discontinuity at the edge of the mould where the films themselves remain in fact perfectly free from the sticky substance. Therefore, in these cakes any possible leakage of sticky material during storage and transportation is fully prevented, even in the case of hot-melts having high fluidity, which exhibit cold flow features at room temperature, especially when the room temperature is particularly high, as happens in the season summer or in special storage conditions. Also, the parallelepiped shape of said cakes makes easier their packaging in boxes, with a greater efficiency of filling the overall volume of the box.

In addition to the drawbacks discussed above in relation to the cakes obtained with the three in-water processes, it should also be noted that, from the point of view of the technical characteristics of the relevant production plants, the use of cooling water causes:

- issues in terms of environmental sustainability;
- high energy consumption for cooling water and also for the final drying of the cakes extracted from the cooling tank;
- the presence of residual moisture or air bubbles, which result in the creation of harmful foams in melting devices and the malfunctioning of the relative nozzles; and finally
- the easy formation of colonies of bacteria in the tanks containing the cooling water, which may cause sanitary problems. This can occur when different hot-melt products not perfectly dried are used on products in the food and medical field, on which therefore a part of the bacterial load contained in the cooling water can be transferred.

None of these additional drawbacks is instead shown by the fourth packaging dry process, where, on the other hand, in the winter season there is the additional advantage that the heat dissipated by air during the cooling of the cakes allows the heating of the factory without additional costs.

Conversely, notwithstanding the various drawbacks mentioned above, the packaging in-water processes exhibit lower plant costs than the dry process and, moreover, they allow to operate by using lining films having lower softening temperatures, since the direct cooling of the film with water allows to maintain the film at a set temperature, equal to the cooling water temperature, which is therefore always sharply lower than the above-mentioned softening temperature.

This latter feature of the wet processes is very attractive. In fact, there is a constant pressure of the market towards the use of lining films with low softening temperatures, so as to facilitate the complete and homogeneous melting of the film itself in the sticky material when this is placed in melting devices for its use, given that these devices are not provided with stirrers.

In the context of the clear advantages that the dry process offers compared to the in-water packaging processes, both from the point of view of the product (i.e., edges fully sealed and stackable form) and of the process (i.e., no use of cooling water and no health security issues), object of the present invention is to improve and to make more reliable the dry packaging process described above, with the aim of making possible the use in this process of lining films having a very low softening temperature—such as those currently used in in-water packaging processes—for example films having a Vicat softening temperature about equal to or less than 75° C., without causing an increase of the negative occurrences of holing/tearing said film during the processing stages of the cake, beyond the current error standards.

SUMMARY OF THE INVENTION

The above described object is attained by means of a process for packaging substances in the molten state, which substances are sticky at room temperature or treatment temperature, of the type in which the sticky substance is cast into a tray-mould lined beforehand with a film of plastic material which is non-sticky at room temperature or treatment temperature and compatible in the fluid state with said sticky substance, said process having the features as defined in claim 1. Other preferred features of the packaging process according to the present invention are defined in the dependent claims.

BRIEF DESCRIPTION OF THE DRAWING

Further features and advantages of the packaging process according to the present invention will be more evident from the following detailed description of a preferred embodiment of such a process, provided purely by way of non limiting example, with reference to the accompanying drawing in which one preferred flow diagram of this process is shown.

DETAILED DESCRIPTION OF THE KNOWN PRIOR ART

The present invention has been completed on the basis of extensive studies conducted by the Applicant on the dry packaging process described in the introductory part of the present description, in particular on the conditions that cause the most detrimental error condition of said process, namely the uncontrolled melting of the non-sticky plastic film having a low Vicat softening temperature—which film is preferably used as a lining material for the melted sticky substance—resulting in a direct contact between the walls of the tray-mould and the melted sticky substance.

As it is clearly disclosed in the above cited prior patent EP-718 199, the whole content of which is incorporated herein by reference, the packaging process of the present invention—which is preferably carried out on a continuous tray conveyor belt, each element of which consists of 3 or 4 flanked tray-moulds, which moves in successive steps between the different work stations—is divided substantially into four stages arranged on the length of the conveyor belt.

In a first stage (I), the tray-moulds, consisting of rigid metal elements which are finely perforated in their bottom surface and at least partly in their side surfaces, are lined with a non-sticky plastic film. Such a lining (R) is preferably carried out by forming the film under vacuum, after the latter has been suitably heated and thus seal blocked on the tray-mould, by connecting a vacuum source to a chamber formed at the external lower part of the tray-mould, said chamber being then in communication with the fine holes formed in the tray-mould. In the tray-moulds so prepared, the melted sticky substance is then cast (C) in a carefully set quantity and with a non-turbulent flow through wide mouth shutters having an anti-drip device, feed by a load cylinder-piston assembly.

In a second stage (II), the mould thus filled, and in particular the free surface of the sticky substance cast therein, is cooled with a suitable ventilation with air as it moves along the conveyor belt, to obtain a sufficient degree of stabilization of the free surface.

In a third stage (III) said free surface is covered with a second film of non-sticky material, and the two films are then heat-welded one another at the edges of the mould.

In the fourth and last stage (IV), the two films of non-sticky material are cut immediately outside the welding zone, the material of said films surrounding the tray-moulds is removed, and finally the packaged cakes are released from the tray-moulds and sent to the packaging through a series of successive conveyor belts in which the further cooling of the cakes is performed up to an acceptable temperature for said packaging operations.

DETAILED DESCRIPTION OF A PREFERRED EMBODIMENT OF THE INVENTION

Following these studies, the Applicant has been able to verify that the critical stage of the process, within which the most detrimental error conditions for the safety of the process can occur, is the first stage (I) described above, wherein the contact between the sticky substance melted to its higher temperature and the first film of non-sticky material takes pace. In fact, in this stage there is a plurality of parameters to keep under control at the same time so that the lining operation (R) of the mould takes place with a perfect adhesion between film and tray-mould but without forming holes located at the holes of the tray-mould in connection with the vacuum source. In fact, if this delicate operation is not optimally performed, the subsequent casting (C) of molten sticky substance on the tray-mould thus lined can easily cause localized melting and tearing of the film in areas where such contact shows any discontinuity and then where the film is not constantly cooled and mechanically supported by the underlying tray-mould.

It must be emphasized, in fact, that using lining films having a very low softening temperature, this temperature is in most cases lower than the temperature of the molten sticky substance. When the molten sticky substance is put in contact with the film, as a result there is always a partial melting of the latter. However, since the casting (C) of the melted sticky substance is performed with a non-turbulent flow, when the film has been successfully thermoformed to be intimately adhered to the tray-mould, no mixing between the two molten materials takes place, and then, once solidified, on the outside of the cake a layer of non-sticky material always remains.

According to the present invention, in order to achieve the above mentioned purpose and thus to allow the use of lining non-sticky films characterized by a low Vicat softening temperature, the dry process of the prior art has been further implemented. This implementation involves, on the one hand, the insertion of a stage for the modulation of the vacuum formation rate in the chamber below the tray-moulds, in order to make more gradual the thermoforming operation of the first non-sticky film, and, on the other hand, a plurality of repetitive controls of the physical parameters characterizing the lining operation of the tray-moulds with the film of non-sticky plastic material, both while this operation is carried out and after its completion, to verify that such parameters fall within set acceptability ranges and that therefore the lining operation has been carried out correctly.

In sporadic cases of non-compliance of the verified parameters in comparison with acceptable set ranges, the resulting action is the deactivation of the casting stage (C) of sticky substance in the tray-moulds on which a significant non-compliance of the checked parameters has been revealed. Preferably, the control action is performed independently on each mould, instead than globally on all the moulds of a single tray of the conveyor belt undergone to the lining operation at the same time, so that this preventive control action will lead to the possible deactivation of the casting stage on a limited number of tray-moulds. The productivity is therefore affected only minimally by this preventive control action, but, on the other hand, film tearing conditions are completely prevented, along with the consequent contact of the sticky substance with the tray-mould, which conditions should require instead the immediate shutdown of the entire plant in order to perform complicated cleaning operations causing a substantial production loss.

Instead, in the ordinary case in which the result of all the controls is consistent with the acceptable values, the required operations of filling (C) of the tray-moulds are carried out, along with the conveying operations of the filled tray-moulds, up to the third stage (III) of the process, namely the lining of the upper surface of the mould with the second non-sticky film. However, both of these operations, according to a further feature of the invention, are carried out by modifying the graduality by which the filling and movement transients of the tray-moulds are performed, so as to ensure that the relative stresses between the film and the mould are always sufficiently low as not to create micro-detachments between these two elements, namely to maintain a continuous and intimate contact between each other. In fact, any alteration of this continued and intimate contact condition between the film and the mould, until the melted adhesive substance is not at least partially cooled, result in an immediate melting of the film and consequently the direct contact between the mould and the molten adhesive substance, causing the above described drawbacks.

Based on this coordinated action of:

- modulation of the vacuum formation rate in the chamber below the tray-moulds;
- identification of parameters representative of the correct execution of the tray-mould lining operation with the film of non-sticky material;
- experimental verification of acceptable ranges of values of these parameters;
- control of these parameters on each individual tray-mould;
- consequent corrective action, in case of non-compliance of parameters, consisting in the deactivation of the casting of molten sticky material on the single-mould tray on which the non-compliance of the parameters in comparison with the range of acceptable values has been revealed; and
- maintainment of a continuous and intimate contact between the first lining film of the tray-moulds and the internal surface of said tray-moulds, during the filling of the tray-moulds with the melted adhesive substance and the movement of said tray-moulds up to the conclusion of the third stage of covering the tray-moulds with the second non-sticky film;

the present invention has been therefore accomplished. These individual innovative aspects of the dry packaging process according to the present invention will be separately described in greater detail below.

Modulation of the Vacuum

In the prior art process, the connection between the vacuum source and the vacuum chamber formed below the lower area of the moulds, is carried out by the direct activation of a traditional ON/OFF electric valve. This causes the curve of the vacuum formation in said chamber to be very abrupt and uncontrolled. On the contrary, according to the present invention, a satisfactory modulation in the formation of the degree of vacuum in the chamber below the lower external portion of the tray-moulds is obtained by using, in order to adjust the opening of the connection of said chamber with the vacuum source, a regulating valve driven by an electric valve with an opening ramp which can be programmed by a centralized control (V). The control (V) for opening said electric valve, which preferably is part of a central unit (U) for controlling the entire process, can be suitably calibrated by electronic mode, thus allowing to modulate at will the ramp of the degree of vacuum formation during the opening transient of said connection to obtain the desired action graduality. This allows to modify and make more gradual the thermoforming operation of the non-sticky film material on the mould, without any increase in the overall duration of this operation, avoiding the drawbacks that frequently occur in the prior art process, namely the formation of film areas having lower mechanical resistance, due to the mechanical stress and consequent embrittlement caused by a too abrupt stretching action on said film.

Identification of Representative Parameters and Related Controls

The process parameters which have been identified by the Applicant as the most representative of a correct execution of the lining operation of the tray-moulds, and which therefore, according to a main feature of the present invention, are subjected to the aforementioned action of continuous control on each individual mould, are the following:

- temperature of the first film of non-sticky material at the entrance in the thermoforming zone;
- temperature of the tray-moulds in the thermoforming zone;
- the time required for the vacuum formation, i.e. the time required to obtain the desired degree of vacuum in the vacuum chamber below the external lower zone of the tray-moulds, after the opening of the connection of such chamber with the vacuum source;
- maintainment of the vacuum over the time, i.e. the value of the degree of vacuum in the vacuum chamber below the external lower zone of the tray-moulds, after a set period of time from the closing of the connection with the vacuum source.

The relevant control modes and the preferred acceptable ranges of values, for each of said parameters, which have been identified during the experimental trials of preferred embodiments of the process of the present invention will be described in the following. It is clear, however, that these ranges of acceptable values should be understood as exemplary and not limitative values of the present invention, being well clear to a person skilled in the art that these values may vary, even significantly, for example depending on the size of the tray-moulds, the type of material treated, the type of lining film, the weather conditions of the plant locations, etc.

Checking the Film Temperature Before the Thermoforming—T1

A first control is carried out on the average temperature in the area immediately before the lining area of the moulds and the cast area of the molten sticky substance; with a good approximation, such a temperature corresponds to the temperature at which the first film of non-sticky plastic material entering the lining area is conditioned.

In order to minimize the local temperature fluctuations in this area—as it was found that said temperature fluctuations may easily cause localized anomalies in the thermoforming conditions of the first film—according to the present invention it is provided that the air volume of this zone of the plant is conditioned to a controlled temperature, or to a narrow range thereof, by means of a suitable containment of such an air volume by using bulkheads and a controlled heating, with the aim of maintaining the air temperature to a constant and homogeneous value throughout the abovementioned volume, and therefore to ensure that the film arrives to the preheating station always at the same temperature and then exits from the subsequent heating station always at a same (although of course higher) temperature. Preferably, this constant temperature value is maintained unchanged during the whole year, irrespective of seasonal variations of the external temperature, because this allows to maintain a constant setting of all the variable parameters of the machine, in particular the preheating and heating temperature of the film and the modulation of the vacuum, regardless of the varying conditions of external moisture and temperature. This temperature will be selected in order to have the minimum total energy consumption on an annual basis, according to the seasonal average conditions in the area of the plant. An exemplary value of this temperature is 40° C., where the maximum permissible oscillation thereof is ±5° C. and, preferably, ±2° C.

Where the average temperature detected is lower than the minimum value defined as acceptable, a first control (T1) sends a signal to the casting activation block (A) that disables the casting of melted sticky substance (C) on all moulds; simultaneously, the activation block (A) turns off the cooling ventilation on the entire plant. This situation is typical of the start of production or after extended periods of work suspension.

When, on the contrary, the average temperature detected by the control (T1) is close to the maximum value of the acceptability range, the activation block (A) activates an additional cooling ventilation of the plant.

Controlling the Temperature of Tray-Moulds—T2

The detection of the internal temperature of the tray-moulds is performed by means of pyrometers at the station for the thermoforming and filling of the moulds. The temperature thus detected should preferably be above a minimum temperature value, below which the film is not properly thermoformed due to the immediate shrinkage of the film, having a a thickness also lower than 10 μm), due to the thermal shock caused by the abrupt contact with the cold surface, when it is put in contact with the tray-mould walls. This minimum value of temperature varies depending on the type of material and the thickness of the film of non-sticky material; indicatively, this minimum temperature of the moulds is in the range of 5-15° C.

However, the temperature measured on the tray-moulds must not even be higher than a maximum value, beyond which the film of non-sticky material may suffer from excessive thinning, lacerations or instability during the thermoforming operation, considered that, because of the high temperature of the tray-mould, eventually the film will be maintained above its softening temperature for an excessively long period of time. Again, this maximum value varies according to the type of material and the thickness of the film of non-sticky material; indicatively, this maximum temperature of the moulds is in the range of 40-50° C.

As already said in the introductory part, when the control unit (T2) detects that the internal temperature of the tray-moulds is out of a set temperature range for the specific material being processed, the film thermoforming operation is regularly performed but the next filling process of the moulds is deactivated by the activation block (A) only at the moulds on which the anomalous temperature was detected.

Controlling the Vacuum Forming Time—V1

The vacuum forming time is calculated by a first control (V1) from the opening of the connection with the vacuum source of the chamber below the tray-moulds, until the desired degree of vacuum is reached. This time value must be comprised within a set range. In fact, if the vacuum forming time is too short, this means that a portion of the holes of the tray-moulds is clogged and thus the formation of the vacuum takes place on a part of the mould only. If, on the contrary, the vacuum forming time is too long, this means that the film is perforated at one or more holes of the tray-mould.

In both cases, at all the tray-moulds on which anomalous vacuum forming time values were found, the activation block (A) deactivates the mould-filling stage (C).

A preferred acceptable time range, for a correct formation of the vacuum in the vacuum chamber below the tray-moulds, is 1-3 sec.

According to an additional control mode, the individual tray-moulds are individually numbered in an electronically traceable manner, and the activation block (A) stores the number of the tray-mould on which incorrect vacuum forming time values were found, and then controls over time if the error on that particular mould is either random or repetitive in nature. In this second case, a mould fault signal is sent to activate a replacement/maintenance stage thereof.

Controlling the Vacuum Maintenance—V2

A second control (V2) of the degree of vacuum is provided immediately after the closing of the connection of the chamber below the external lower part of the moulds with the vacuum source, to control whether the drop of such degree of vacuum is too rapid, thus revealing the presence of holes or tearings on the lining film.

Such control is carried out simply by measuring the value of the vacuum degree after a set time from the actual closing of the connection with the vacuum source and by verifying that this value is not less than a set threshold value. Exemplary acceptable values may for example be a waiting time up to 1 second and a value of the degree of vacuum drop, measured at the end of the waiting time, between −0.15 and −0.20 bar, compared to a maximum value of vacuum degree, at the time of closing of the connection, between −0.20 and −0.30 bar.

When the degree of vacuum drop is greater than the threshold value, determined for each individual application, the activation block (A) deactivates the filling stage of the tray-moulds with the molten sticky substance at the tray-moulds on which the anomaly was found.

Maintaining a Continuous and Intimate Contact Between First Film and Tray-Moulds Finally, a last feature of the packaging process of the present invention has the aim to ensure the abovementioned continued and intimate contact between the first film of non-sticky material and the inner walls of the tray-moulds, starting from the end of the lining stage and until the conclusion of the third stage (III) of the process, i.e., the covering of the free surface of the molten sticky substance contained in the tray-moulds with a second film of non-sticky material. This object is achieved by means of two changes to the known process. A first change was implemented in the control of the cylinder-piston assembly which powers the casting shutters of sticky substance in the tray-moulds. Such an assembly is in fact controlled by a step motor that allows to adjust smoothly the startup and stop ramps of the flow, so as to minimize the effect of the first impact of the flow on the first film applied on the tray-mould, and to maintain then non-turbulent flow conditions throughout the casting period. The purpose of this, as already anticipated above, is to avoid any possible relative displacement between the lining film and the surface of the tray-mould during the casting operation (C); in fact, a displacement, however small it is, would cause the immediate melting of the film during the casting of the molten adhesive.

Instead, a second modification, having the same purpose of maintaining a continued and intimate contact between the film and tray-moulds, concerns the control of the chains that drive the conveyor belt of the tray-moulds and, respectively, those that drive the first film of non-sticky material. According to the present invention, both of these drive chains are in fact operated by step motors, adjusted so as to have startup and stop transients, between every single working step, which are particularly smooth and synchronized. In fact, it is necessary to avoid with the utmost care every possible position deviation between the above two drive chains, since this would lead to a possible detachment of the first film from the inner surface of the tray-moulds, and this both during the startup and stop transients and throughout the entire length in which the two systems cooperate, i.e., from the lining station of the moulds with the first film up to the cutting station of the two welded films. An acceptable synchronization between the two chains provides a maximum deviation of +/−1 mm between the beginning and the end of the coupling length of the two chains.

A motor control (I), also preferably arranged inside the central unit (U), both adjusts, according to the needed gradually, the startup and stop transients of the casting operation (C) of the melted adhesive substance, as well as the step coordinated displacements of the first film and the tray-moulds, and maintains the aforesaid fine synchronization between the driving systems of said first film and the tray-moulds.

Conclusion

Thanks to this new and unique combination of features, the dry packaging process of the present invention has fully reached the intended object. In fact, by optimizing the process conditions and monitoring the critical parameters for detecting possible non-compliance situations, it is possible to use lining films having a very low softening temperature, quite comparable to the films used in in-water packaging processes, while maintaining constant and close to zero the level of error conditions which are not detected by the above described controls.

It is understood, however, that the invention is not to be considered as limited by the particular arrangements illustrated above, which represent only exemplary embodiments of the same, but different variants are possible, all within the reach of a person skilled in the art, without departing from the scope of the invention itself, which is exclusively defined by the following claims.

The invention claimed is:

1. A process for packaging substances in a molten state, which substances are sticky at room temperature or treatment temperature, wherein the sticky substance is cast into a tray-mould lined beforehand with a film of plastic material which is non-sticky at room temperature or treatment temperature and compatible in a fluid state with said sticky substance, comprising the following stages:

a) providing a plurality of tray-moulds apt to receive the cast of a sticky substance at the molten state, said tray-moulds having a plurality of through-holes passing through at least part of the walls of said tray-moulds and being arranged in adjacent subsequent rows to form a continuous tray conveyor belt;

b) rapidly lining internal walls of the tray-moulds of one or more trays with a first formable film of said non-sticky plastic material, causing said first formable film to adhere to the walls of the mould by connecting a lower external part of the moulds to a vacuum source;

c) casting into the thus-lined tray-moulds, under pressure and with a non-turbulent flow, a predetermined amount of sticky substance at the molten state;

d) allowing cooling of a free surface of the sticky substance, during a step-like progress of the conveyor belt, until obtaining stabilization of said surface;

e) covering said free surface of the sticky substance with a non-sticky material compatible in a fluid state with said substance; and f) welding said non-sticky material to said first film;

characterised in that said process for packaging substances in a molten state further comprises, in the above-said stage b), to modulate a degree of vacuum during an opening transient of the connection of the lower external part of the mould to the vacuum source by the additional steps of:

g) detecting (V1) a time necessary to reach a first set degree of vacuum, starting from the beginning of the above-said opening transient of the connection to the vacuum source;

h) detecting (V2) a value of the degree of vacuum in the lower external part of the mould, after a set period of time from a closing of the connection to the vacuum source;

i) giving consent (A) to the start of the above-said stage c) only if the time measured in step g) falls within a set range of acceptability and the degree of vacuum measured in stage h) is below a set maximum value.

2. The packaging process as in claim 1, wherein there are further provided the additional stages of:

k) conditioning at a controlled temperature an air volume wherein the tray-mould lining stage and the casting into tray-moulds stage are performed;

l) detecting an average temperature in an area immediately preceding an area in which the tray-mould are lined and the molten sticky substance is cast into the tray-moulds;

m) comparing (T1) said average temperature with an acceptable temperature range set around said controlled temperature;

n) deactivating (A) on all the tray-moulds the casting operation (C) as well as a cooling ventilation on the entire plant should such average temperature be below a minimum value of said range of acceptable temperatures;

o) activating an additional cooling conditioning when such average temperature draws near to a maximum value of said range of acceptable temperatures.

3. The packaging process as in claim 2, wherein there are further provided the additional stages of:

p) controlling (T2) an inner temperature of the tray-moulds, and q) giving consent (A) to the start of the above-said stage c) only when said inner temperature falls within a set range of temperatures.

4. The packaging process as in claim 3, wherein said set range of temperatures in stage q) ranges between 5 and 50° C.

5. The packaging process as in claim 3, wherein said set range of temperatures in stage q) ranges between 15 and 40° C.

6. The packaging process as in claim 2, wherein said controlled temperature of stage k) is equal to 40° C.

7. The packaging process as in claim 6, wherein said range of acceptable temperatures of stage m) is of ±5° C. around said controlled temperature.

8. The packaging process as in claim 6, wherein said range of acceptable temperatures of stage m) is of ±2° C. around said controlled temperature.

9. The packaging process as in claim 1, wherein the acceptability range of the time for reaching the desired vacuum value in the above-said stage g) is from 1 to 3 sec.

10. The packaging process as in claim 1, wherein the degree of vacuum in the lower external part of the mould in the above-said stage h) ranges between −0.15 and −0.20 bar, such value being measured after a period of up to 1 second from the closing of the connection to the vacuum source.

11. The packaging process as in claim 1, wherein the casting operation (C) of the sticky substance of stage c), is obtained through a cylinder-piston assembly operated by a step motor.

12. The packaging process as in claim 1, wherein said first film of non-sticky material is caused to progress in sync with said tray conveyor belt for a length thereof comprised between the tray-mould lining station with the first film of stage b), and a covering station of the free cast surface with the non-sticky material of stage f), the deviation tolerance of said synchronism for the entire above-said length being below +/−1 mm.

13. The packaging process as in claim 12, wherein a drive of said conveyor belt and a drive of the first film of non-sticky material are both controlled by step motors.

14. The packaging process as in claim 13, wherein said step motors are controlled by a motor control (I) so as to cause regular acceleration and braking ramps.

15. The packaging process as in claim 14, wherein said step motors are controlled by the motor control (I) so as to furthermore cause synchronous acceleration and braking ramps between the drive of said conveyor belt and the drive of the first film of non-sticky material.

* * * * *